US008646894B2

(12) United States Patent
Kobayashi

(10) Patent No.: US 8,646,894 B2
(45) Date of Patent: Feb. 11, 2014

(54) LIQUID EJECTING HEAD

(71) Applicant: Seiko Epson Corporation, Tokyo (JP)

(72) Inventor: Yutaka Kobayashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/685,425

(22) Filed: Nov. 26, 2012

(65) Prior Publication Data

US 2013/0141502 A1 Jun. 6, 2013

(30) Foreign Application Priority Data

Dec. 1, 2011 (JP) ..... 2011-263825

(51) Int. Cl.
*B41J 2/19* (2006.01)

(52) U.S. Cl.
USPC ..... 347/92; 347/65; 347/93; 95/268

(58) Field of Classification Search
None
See application file for complete search history.

(56) References Cited

U.S. PATENT DOCUMENTS

| | | | | |
|---|---|---|---|---|
| 4,719,479 | A * | 1/1988 | Kyogoku | 347/93 |
| 6,190,009 | B1 | 2/2001 | Kitahara | |
| 6,338,554 | B1 * | 1/2002 | Kitahara | 347/93 |
| 2001/0035897 | A1 * | 11/2001 | Hayashi et al. | 347/65 |
| 2008/0043059 | A1 | 2/2008 | Okazawa et al. | |

FOREIGN PATENT DOCUMENTS

| | | | |
|---|---|---|---|
| JP | 11-10904 | A | 1/1999 |
| JP | 2009-006730 | A | 1/2009 |

* cited by examiner

*Primary Examiner* — Matthew Luu
*Assistant Examiner* — John P Zimmermann

(57) ABSTRACT

Disclosed herein is a liquid ejecting head in which a liquid introducing portion includes a liquid introducing flow passage which introduces a liquid from a liquid storage member having the liquid stored therein, a bubble chamber which accommodates a bubble entrained into the liquid introducing flow passage and a filter that is provided at a bottom of the bubble chamber, and a liquid ejecting head main body which introduces the liquid from the liquid introducing portion to a pressure chamber through a liquid flow passage and is able to discharge the liquid in the pressure chamber from nozzles as liquid droplets, wherein a lyophobic region having a lyophobic property is provided on a surface of the filter facing the bubble chamber side.

5 Claims, 6 Drawing Sheets

LIQUID EJECTING HEAD

CROSS-REFERENCE TO RELATED APPLICATION

The entire disclosure of Japanese Patent Application No. 2011-263825, filed Dec. 1, 2011 is expressly incorporated by reference herein.

BACKGROUND

1. Technical Field

The present invention relates to a liquid ejecting head such as an ink jet type recording head, and more particularly, to a liquid ejecting head which introduces a liquid stored in a liquid storage member into a pressure chamber through a liquid introducing portion such as a liquid introducing needle, and discharges the liquid introduced into the pressure chamber from nozzles as liquid droplets.

2. Related Art

A liquid ejecting head is, for example, an ink jet type recording head for an image recording apparatus such as an ink jet type recording apparatus (hereinafter, simply referred to as a recording head). However, the liquid ejecting head has been applied to various kinds of manufacturing apparatuses taking an advantage of being able to land very small amounts of liquid precisely onto a designated position. For example, it is applied to a display manufacturing apparatus used for manufacturing a color filter for a liquid crystal display, or the like, an electrode forming apparatus used for forming an electrode for an organic electro luminescence (EL) display, a field emission display (FED), or the like, and a chip manufacturing apparatus used for manufacturing a biochip (biochemical device). A recording head for an image recording apparatus ejects liquid-phase ink, and a color material ejecting head for a display manufacturing apparatus ejects solutions of color materials of R (Red), G (Green), B (Blue). Additionally, an electrode material ejecting head for an electrode forming apparatus ejects liquid-phase electrode materials, and a bio-organic substance ejecting head for a chip manufacturing apparatus ejects solutions of a bio-organic substance.

In the above-mentioned recording head, for example, an ink introducing needle which is a kind of liquid introducing needle is inserted into an ink cartridge as a liquid storage member having liquid-phase ink enclosed therein. Accordingly, the ink stored in the ink cartridge is introduced from the ink introducing needle to a pressure chamber side through a ink flow passage in the recording head. A pressure variation is generated in the pressure chamber by driving of a pressure generating unit, and the pressure variation is used to eject (discharge) the ink from nozzles as liquid droplets.

In the above-mentioned recording head, however, when connecting the ink cartridge to the ink introducing needle, bubbles could be mixed in and flow to the ink introducing needle. If the bubbles are entrained into the pressure chamber side through the ink flow passage, there is concern that defects could be caused, such as pressure loss which is caused by the bubbles absorbing the pressure variation which is generated at a recording operation (an ink droplet ejecting operation), or insufficient ink supply which is caused by the bubbles blocking the flow passage.

To solve these problems, it has been proposed that a bubble chamber 72 which communicates with a bottom end of an introducing flow passage 71 on an upstream side, and a filter 73 which is provided at the bottom of the bubble chamber are included in an ink introducing needle 70, as shown in FIGS. 6A to 6C (for example, see JP-A-2009-006730). Therefore, it is possible that the ink flowing from the upstream side to the downstream side is filtrated by the filter 73, whereby the bubbles B entrained in the ink are accommodated in the bubble chamber 72. As a result, the bubbles B are not permitted to flow to a downstream side at the recording operation. Also, the bubbles B accommodated in the bubble chamber 72 are discharged compulsively by a cleaning operation. Specifically, a flow rate of the ink in the ink introducing needle 70 is set to be greater than that in the recording operation, whereby a greater pressure difference is generated between the upstream side and the downstream side comparing to that in the recording operation. Accordingly, the bubbles B in the bubble chamber 72 are compulsively sent to the downstream side through the filter and then discharged from the nozzles with the ink, as shown in FIG. 6B.

A filter 73 with a lyophilic property (a contact angle θ of the ink with respect to the filter 73 is less than 90°) is used as the above-mentioned filter 73, so as to not permit a flow of the ink passing the filter 73 from being disturbed by the bubbles B covering a surface of the filter 73 at the recording operation. However, in such a filter 73, a contact size between the bubble B and the filter 73 becomes small at the cleaning operation, as shown in FIG. 6B. That is, the ink goes around and cuts in between the bubble B and the filter 73, and then the ink flows downward with avoiding the bubble B. As a result, there is a liability that the bubbles B are discharged insufficiently during the cleaning operation, and the large bubbles B remain in the bubble chamber 72, as shown in FIG. 6C. If the large bubbles B remain in the bubble chamber 72, there is concern that the bubbles B flow into the pressure chamber side erroneously or a flow of the ink toward the pressure chamber side is disturbed during the recording operation.

SUMMARY

An advantage of some aspects of the invention is to provide a liquid ejecting head capable of discharging bubbles in a bubble chamber easily by a cleaning operation.

According to an aspect of the invention, there is provided a liquid ejecting head includes a liquid introducing portion which has a liquid introducing flow passage which introduces a liquid from a liquid storage member having the liquid stored therein, a bubble chamber which accommodates a bubble entrained into the liquid introducing flow passage, and a filter which is provided at a bottom of the bubble chamber, and a liquid ejecting head main body which introduces the liquid from the liquid introducing portion to a pressure chamber through a liquid flow passage and is able to discharge the liquid in the pressure chamber from nozzles as liquid droplets, in which a lyophobic region having a lyophobic property is provided on a surface of the filter facing the bubble chamber side.

According to the liquid ejecting head of the aspect of the invention, since a bubble is spread over a surface of the filter by the lyophobic region, a contact size between the bubble and the filter becomes large in a cleaning operation. Therefore, the bubbles are discharged through the filter efficiently. As a result, it is possible to remove the bubbles in the bubble chamber or to reduce the remaining bubbles in the bubble chamber. Note that the lyophobic property means that a contact angle of the liquid with respect to the filter is equal to or more than 90°.

In the above-mentioned configuration, it is preferable that the lyophobic region be provided at a peripheral lyophobic region along a peripheral edge of the filter.

In addition, in the above-mentioned configurations, it is preferable that a lyophilic region showing a lyophilic property be provided at a central portion of the filter.

According to the configuration, if the bubbles still remain in the central portion after a cleaning operation, it is possible to separate the bubbles from the filter reliably. Subsequently, it is possible to prevent a flow of ink passing the filter from being disturbed due to the bubbles in a recording operation. Note that the lyophilic property means that a contact angle of the liquid with respect to the filter is less than 90°.

In the above-mentioned configurations, it is preferable that a high void section having a high-porosity is provided at the central portion of the filter and a low void section of which a porosity is lower than that of the high void section is provided at a peripheral portion of the filter outside the high void section.

According to the configuration, it is possible to concentrate a pressure in the central portion of the bubble coming into contact with the filter, where the bubbles tend to be congested. Accordingly, the bubble may be discharged more efficiently through the filter by a cleaning operation.

In the above-mentioned configuration, it is preferable that the low void section be formed in a plate shape through which the bubbles do not pass.

According to the configuration, it is possible to concentrate a pressure in the central portion of the bubble coming into contact with the filter, where the bubbles tend to be congested. Accordingly, the bubbles may be further discharged efficiently through the filter by a cleaning operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. Although the embodiments described below are limited to various specific preferred embodiments of the invention, the scope of the invention is not limited thereto unless the invention is otherwise limited in the following description. Hereinafter, an ink jet type recording apparatus 1 (hereinafter, referred to as a printer), by way of example, will be described as a liquid ejecting apparatus equipped with a liquid ejecting head according to the aspect of the invention.

Figure 1:
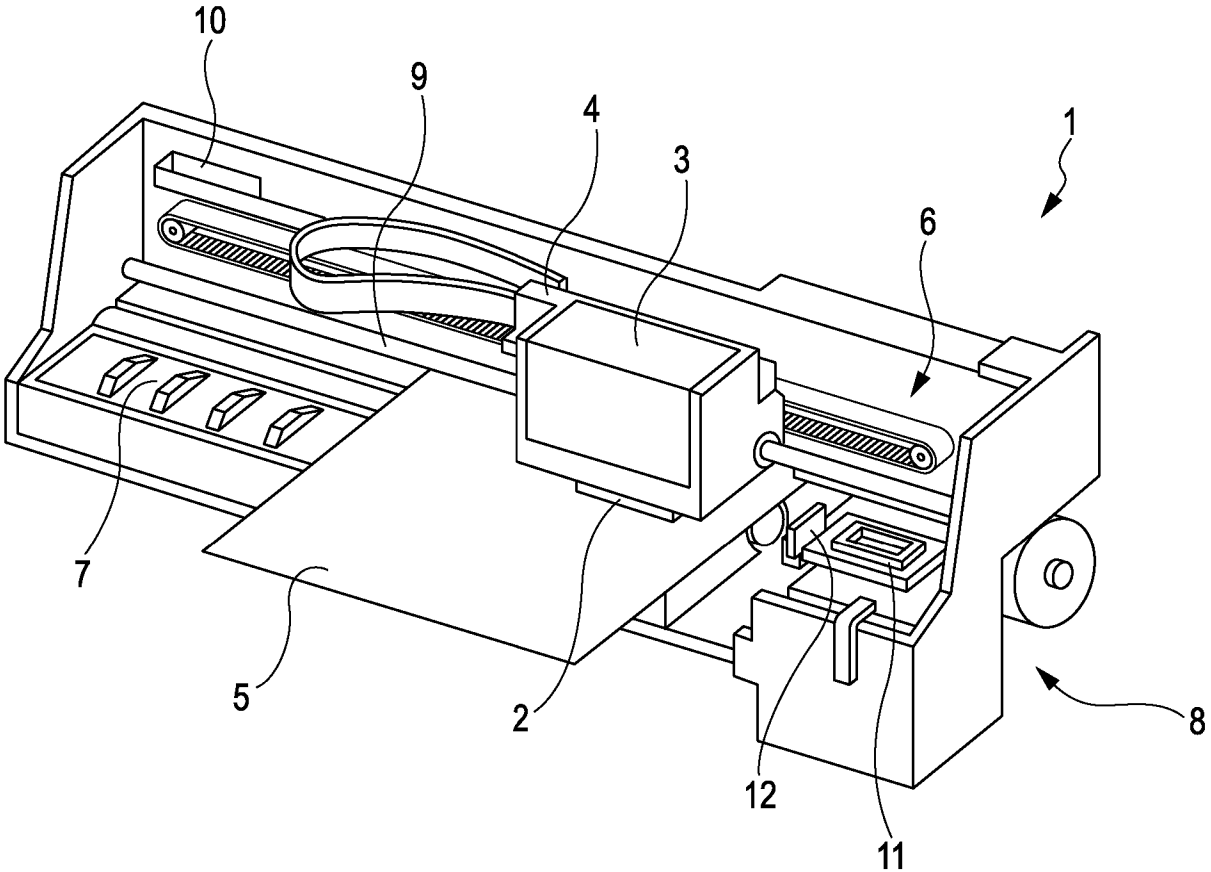
FIG. 1 is a perspective view illustrating a printer.

FIG. 1 is a perspective view illustrating a configuration of a printer 1. The printer 1 includes a carriage 4 in which a recording head 2 which is a kind of liquid ejecting head is mounted and an ink cartridge 3 (which corresponds to a liquid storage member of the aspect of the invention) having ink (which is a kind of liquid) stored therein is mounted detachably. Behind the carriage 4, a carriage moving mechanism 6 is arranged which reciprocates the carriage 4 in a paper width direction of, namely, in a main scanning direction of recording paper 5 (which is a kind of recording medium and landing target). In addition, below the recording head 2, a platen 7 is arranged in an interval manner in a recording operation. The recording paper 5 is transported in a sub-scanning direction perpendicular to the main scanning direction over the platen 7 by a transporting mechanism 8 which is arranged behind the printer 1.

The carriage 4 is mounted in a state of being axis-supported by a guide rod 9 installed in the main scanning direction, and is moved along the guide rod 9 in the main scanning direction by an operation of the carriage moving mechanism 6. A position of the carriage 4 in the main scanning direction is detected by a linear encoder 10 which is a kind of position information detection unit. The detected signal, namely, an encoder pulse (which is a kind of position information) is transmitted to a controller of the printer 1. A home position which is a starting point of scanning of the carriage 4 is set at an end region outside a recording region within a movement range of the carriage 4. The printer 1 performs a so-called bi-directional recording process in which letters, images or the like, are recorded on the recording paper 5 in a bi-directional movement, that is a forward movement in which the carriage 4 moves from the home position toward an end side opposite to the home position and a backward movement in which the carriage 4 is returned from the end side opposite to the home position to the home position.

Also, the home position is disposed with a capping member 11 to seal a nozzle forming surface (a nozzle plate 36: see FIG. 3) of the recording head 2 and a wiper member 12 to sweep the nozzle forming surface. The capping member 11 is a tray-shaped member with open top surface, and has a rectangular-shaped bottom portion and a sidewall portion projected from the peripheral edge of the bottom portion. The capping member 11 is made from an elastic member such as rubber. The capping member 11 is connected to a pump (not shown) to depressurize the inside thereof. Therefore, by driving the pump after sealing the nozzle forming surface with the capping member 11, the bubbles and the thickening ink in the recording head 2 are sucked out (a cleaning operation). In the cleaning operation, a larger amount of ink is sucked out compared to that of ink discharged from nozzles 40 at the recording operation.

The recording head 2 includes a liquid introducing needle 14 (which corresponds to a liquid introducing portion according to the aspect of the invention) which is connected with the inside of the ink cartridge 3 and a recording head main body 15 (which corresponds to a liquid ejecting head main body according to the aspect of the invention) which is disposed below the liquid introducing portion. The liquid introducing needle 14 of the embodiment is provided above the recording head main body 15. Thereby, when the ink cartridge 3 is mounted on the recording head 2, the liquid introducing needle 14 is inserted in the inside of the ink cartridge 3.

An introducing flow passage 17 and a bubble chamber 18 are formed in the inside of the liquid introducing needle 14. A plurality of liquid introducing holes 16 are formed on a tip of the liquid introducing needle 14. The liquid introducing holes 16 introduce the liquid from the ink cartridge 3 to the introducing flow passage 17. The introducing flow passage 17 is a cylindrical-shaped flow passage, and is communicated with by the liquid introducing holes 16 at the top end thereof and is communicated with by the bubble chamber 18 at the bottom end thereof. Also, the liquid introducing holes 16 and the introducing flow passage 17 correspond to a liquid introducing flow passage according to the aspect of the invention.

The bubble chamber 18 is a chamber to accommodate the bubbles B entrained in the introducing flow passage 17. At the opening in a bottom thereof, the bubble chamber 18 faces a filter 19 which is disposed on the recording head main body side. The bubble chamber 18 of the embodiment is formed in a shape in which the inner diameter thereof is gradually widened from the introducing flow passage 17 side toward the filter 19 side. In the head main body 15, a filter chamber 20 is formed at in the portion corresponding to the bubble chamber 18. The filter chamber 20 is formed in a funnel shape in which the inner diameter is gradually narrowed from the filter 19 side toward a downstream side. The filter 19 is disposed at the opening portion of the filter chamber 20 in an upstream side. That is, the filter 19 is positioned at a boundary between the bubble chamber 18 and the filter chamber 20, and filtrates the ink which flows from the bubble chamber 18 side toward the filter chamber 20 side. Also, the filter chamber 20 is communicated with by a communicating flow passage 21 at the bottom side. The top end of the communicating flow passage 21 is communicated with by the filter chamber 20 and the bottom end thereof is communicated with a case flow passage 30 (as will be described later).

Figure 2A:
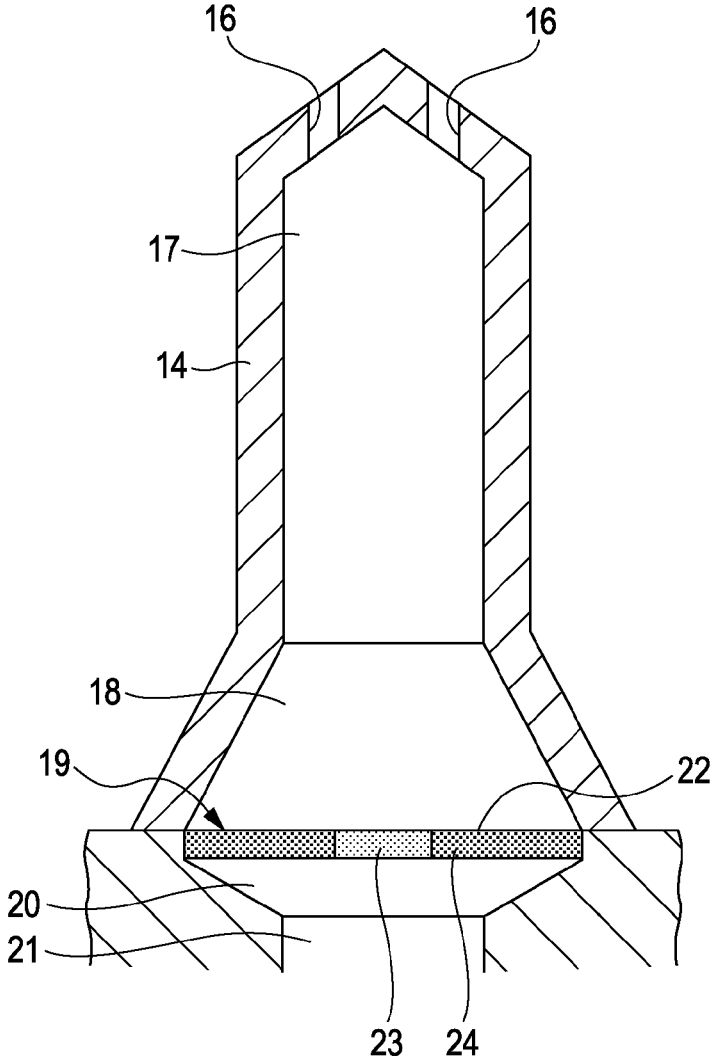
FIG. 2A is a sectional view of a liquid introducing needle and FIG. 2B is a top view of a filter.
Figure 2B:
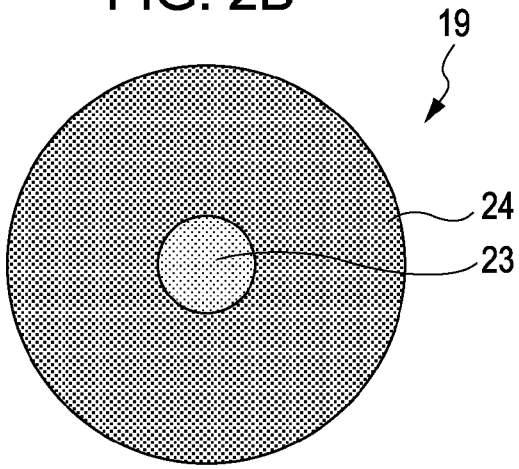

The above-mentioned filter 19 is, for example, formed in a mesh shape with a thin wire which is made from metal, or the like, in a woven manner. In a surface of the filter 19 facing the bubble chamber 18 side, a lyophobic region 22 having a lyophobic property (that is, a contact angle of the ink with respect to the filter 19 is equal to or more than 90°) is provided. In the embodiment, the whole surface of the filter 19 facing the bubble chamber 18 side is coated so as to have a lyophobic property. That is, the whole surface of the filter 19 facing the bubble chamber 18 side is the lyophobic region 22. Such a filter 19 is, for example, made by coating a metallic filter base material with lyophobic materials (silicone resins, fluoride resins, or the likes). Also, as shown in FIG. 2B, a high void section 23 having a high-porosity is provided at the central portion of the filter 19, and a low void section 24 having a porosity lower than the high void section 23 is provided at a peripheral portion (a peripheral portion side outside the high void section 23) of the filter 19. That is, the ink and the bubbles B in a cleaning operation easily pass the high void section 23. The cleaning operation will be described later.

Figure 3:
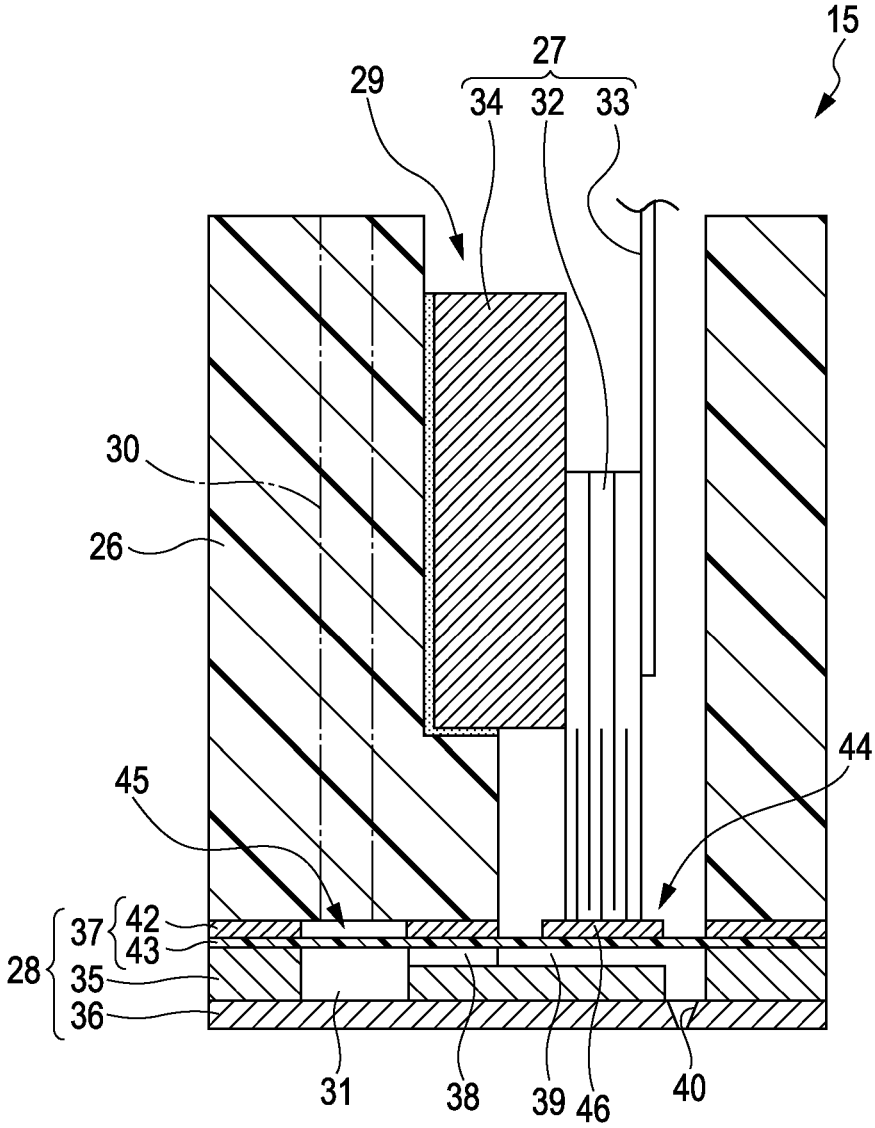
FIG. 3 is a sectional view illustrating a principal portion of a recording head main body.

As shown in FIG. 3, the recording head main body 15 includes a head case 26, a vibrator unit 27 and a flow passage unit 28. The head case 26 is a hollow-box shaped member made from an epoxy based resin, for example, and the flow passage unit 28 is fixed to the end surface (a bottom surface) thereof, and the vibrator unit 27 is accommodated in a storage space 29 which is formed in the case. Also, a case flow passage 30 is formed in the head case 26 piercing through thereof in a height direction. The case flow passage 30 is a flow passage to supply the ink from the liquid introducing needle 14 to a reservoir 31 (described later) and is communicated with by the communicating flow passage 21 at the top end portion thereof.

The vibrator unit 27 includes a plurality of piezoelectric elements 32 which are aligned in a pectinate manner, a flexible cable 33 (a wiring member) to supply a driving signal from a driving substrate to the piezoelectric elements 32, and a fixing plate 34 to fix to one end of each piezoelectric element 32. The end surface of the other free end of each piezoelectric element 32, which is not fixed to the fixing plate 34, is combined with an after-mentioned island portion 46 (a vibrating plate 37). Also, the piezoelectric elements 32 are expanded and contracted by applying the driving signals to expand and contract a volume of the pressure chamber 39, whereby a pressure variation of the ink in the pressure chamber 39 is generated. As a result, the ink is ejected from the nozzles 40 by controlling the pressure variation.

The flow passage unit 28 has a feature in which a nozzle plate 36 is combined with one surface of a flow passage forming substrate 35 and the vibrating plate 37 is combined with the other surface of the flow passage forming substrate 35. In the flow passage unit 28, a continuous flow passage which includes the reservoir 31 (a common liquid chamber), an ink supply port 38 and the pressure chamber 39 is provided. The reservoir 31 is a lengthy space portion along the row direction of the nozzles and the case flow passage 30 is communicated with at the top portion thereof. The ink supply port 38 is a narrowing portion with a narrow width of a flow passage, and communicates with the reservoir 31 with each of the pressure chambers 39. The pressure chamber 39 is a lengthy space portion along a direction perpendicular to the row direction of the nozzles, and is communicated with (open to) the nozzles 40. Also, the continuous flow passage which includes the case flow passage 30, the reservoir 31 and the ink supply port 38 corresponds to the liquid flow passage according to the aspect of the invention. The ink is introduced from the liquid introducing needle 14 to the pressure chamber 39 through the liquid flow passage.

The above-mentioned nozzle plate 36 is a thin plate made from stainless steels, silicon crystals, or the likes, and has a plurality of nozzles 40 which are bored and arranged in series with a pitch corresponding to a dot forming density (for example, 180 dpi). The nozzle row of the embodiment is composed of 180 nozzles 40, for example.

The above-mentioned vibrating plate 37 has a dual structure in which an elastic film 43 is laminated on a surface of a support plate 42. In the embodiment, the vibrating plate 37 is made by using a composite plate in which the support plate 42 is made of a stainless steel plate (which is a kind of metal plate) and the elastic film is made of a resin film, and the elastic film 43 is laminated on the surface of the support plate 42. A diaphragm portion 44 is provided on the vibrating plate 37 to change a volume of the pressure chamber 39. Also, a compliance portion 45 is provided on the vibrating plate 37 to seal a part of the reservoir 31.

The above-mentioned diaphragm portion 44 is formed through partially removing a part of the support plate 42 opposite to the pressure chamber 39 by an etching method, or the like. That is, the diaphragm portion 44 includes the island portion 46 and a thin elastic portion which surrounds the island portion 46. The island portion 46 is combined with an end surface of the free end (which is an end portion opposite to the other end portion fixed to the fixing plate 34) of the piezoelectric element 32. The above-mentioned compliance portion 45 is formed through removing a part of the support plate 42 opposite to the opening surface of the reservoir 31 by an etching method, or the like, in the same manner as forming the diaphragm portion 44. The compliance portion 45 functions as a damper to absorb a pressure variation of the ink stored in the reservoir 31.

Since the end surface of the piezoelectric element 32 is combined with the island portion 46, the volume of the pressure chamber 39 is changed through expanding and contracting the free end of the piezoelectric element 32. The pressure variation of the ink in the pressure chamber 39 is generated by the volume variation. Therefore, the recording head main body 15 ejects (discharges) the ink droplets from the nozzles 40 by using the pressure variation.

Figure 4A:
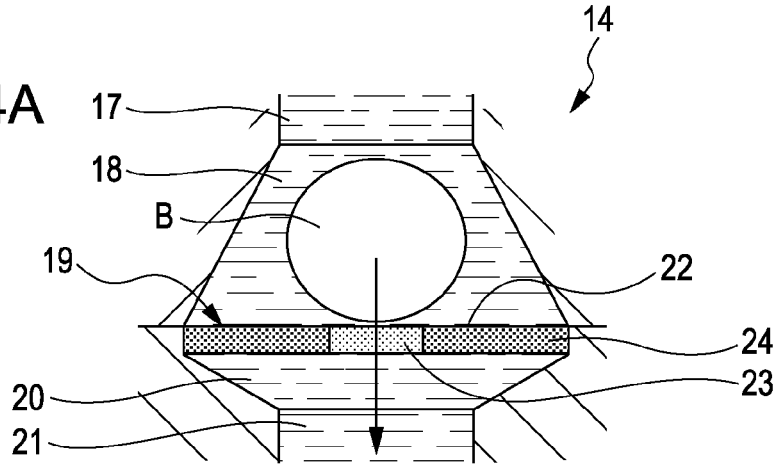
FIGS. 4A to 4C are schematic views illustrating a discharge process of bubbles from a bubble chamber.
Figure 4B:
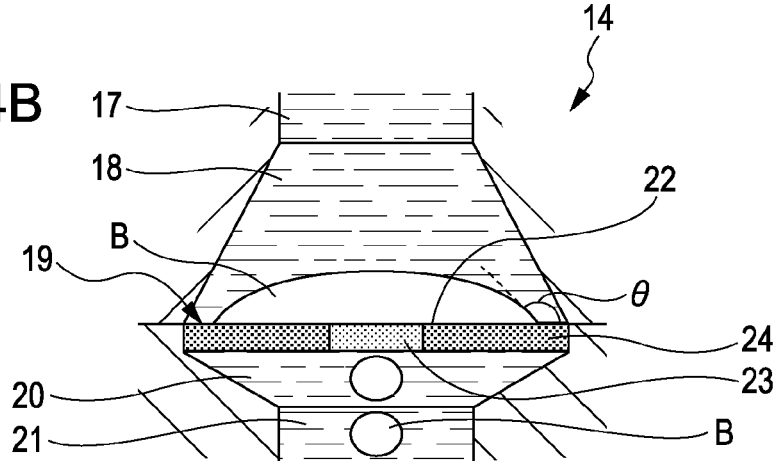

Next, the bubble discharging process of the bubble chamber 18 will be described with reference to FIGS. 4A to 4C. For example, when the internal pressure of the recording head main body 15 (a reservoir 31) is lowered by the cleaning operation, the ink is introduced from the ink cartridge 3 to the introducing flow passage 17 via the liquid introducing holes 16. Thereby, a flow of the ink from the introducing flow passage 17 toward the communicating flow passage 21 is generated. As shown in FIG. 4A, the bubble B in the bubble chamber 18 is moved to the filter 19 side by the flow of the ink and comes into contact with the filter 19. In the embodiment, the whole surface of the filter 19 facing the bubble chamber 18 side is the lyophobic region 22 (a contact angle θ with respect to the filter 19 is equal to or more than 90°, whereby the bubbles B are spread over the surface of the filter 19 as shown in FIG. 4B. Specifically, the bubble B coming into contact with the filter 19 is in a state in which a bubble B is spread over the central portion of the filter 19 concentrically in the plane view of the filter 19 and the central portion thereof bulges out. In the boundary between the bubble B and the ink, an angle formed by the tangent of a portion coming into contact with the filter 19 and a surface of the filter is set as a contact angle θ.

When the bubble B is spread over the surface of the filter 19, a size of the portion of the filter 19 through which the ink passes becomes small, whereby the flow of the ink is disturbed. Thereby, a relatively large pressure difference is generated between the bubble chamber 18 and the filter chamber 20. As a result, the bubble B is easily discharged to the filter chamber 20 side. Subsequently, the bubble B discharged to the filter chamber 20 side rides on the flow of the ink and is discharged from the nozzles 40. In the embodiment, especially, the high void section 23 is provided at the central portion of the filter 19 where an amount of the bubbles B is large, whereby the bubbles B are intensively discharged from the high void section 23 (see FIG. 4B). Therefore, a discharge efficiency of the bubbles B is improved, whereby the bubbles B which have not been discharged at the cleaning operation and remain in the bubble chamber 18 are reduced.

Figure 4C:
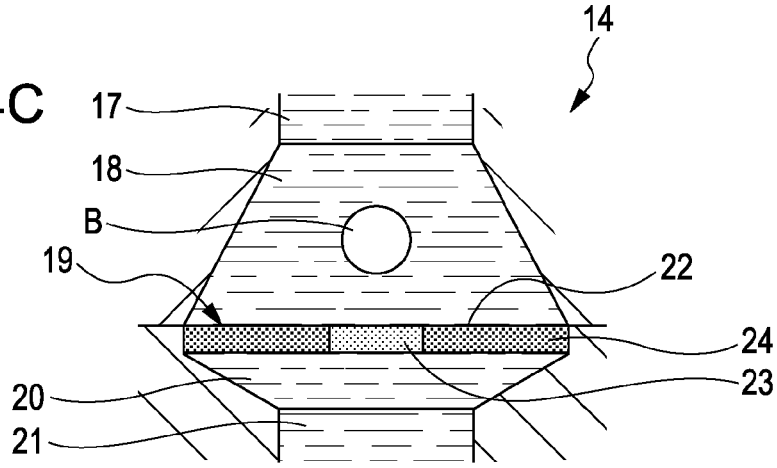

As shown in FIG. 4C, the bubbles B which have not been discharged at the cleaning operation and remain in the bubble chamber 18 move upward by buoyancy, thereby being separated from the filter 19. Also, in the recording operation, since an amount of the ink discharged from the nozzles 40 is smaller than that at the cleaning operation, as well as an amount of the ink flowing inside of the liquid introducing needle 14 is small, whereby the bubbles B do not move to the filter 19 side. As a result, a discharging of the bubble B to the recording head main body 15 side is suppressed in the recording operation.

Since the bubble B is spread over the surface of the filter 19 by the lyophobic region 22 in the cleaning operation, a contact size between the filter 19 and the bubble B becomes large. Thereby, the bubbles B are discharged efficiently through the filter 19. As a result, the bubbles B in the bubble chamber 18 are removed or the bubbles B remaining in the bubble chamber 18 are reduced. Also, in the embodiment, since the high void section 23 is provided at the central portion of the filter 19, a pressure is concentrated in the central portion of the bubble B coming in to contact with the filter 19 where the bubbles B tend to be congested. Thereby, the bubbles B are discharged more efficiently through the filter 19 by the cleaning operation.

Figure 5A:
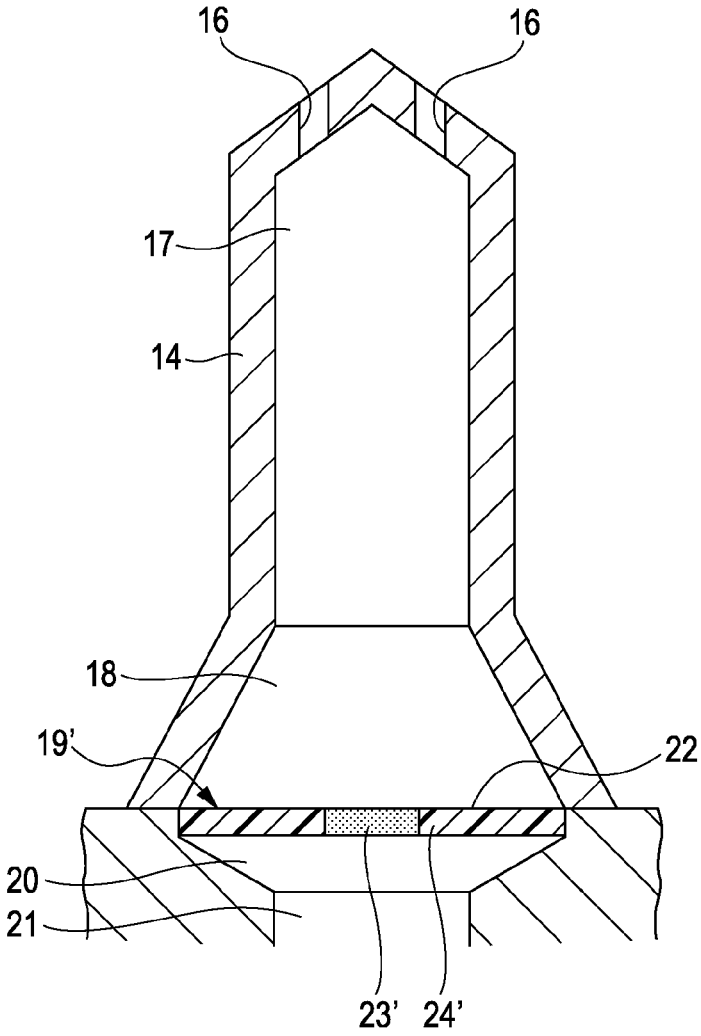
FIG. 5A is a sectional view of a liquid introducing needle according to a second embodiment and FIG. 5B is a top view of a filter according to the second embodiment.
Figure 5B:
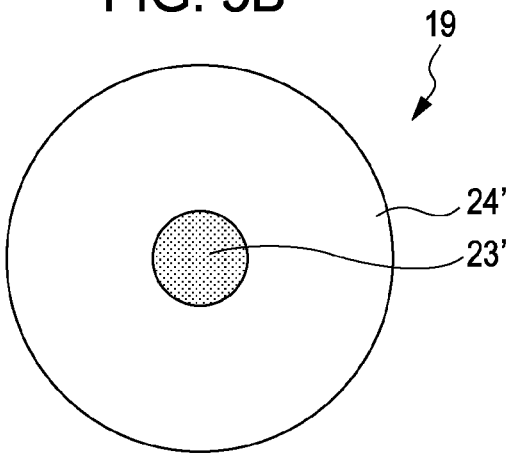
Figure 6A:
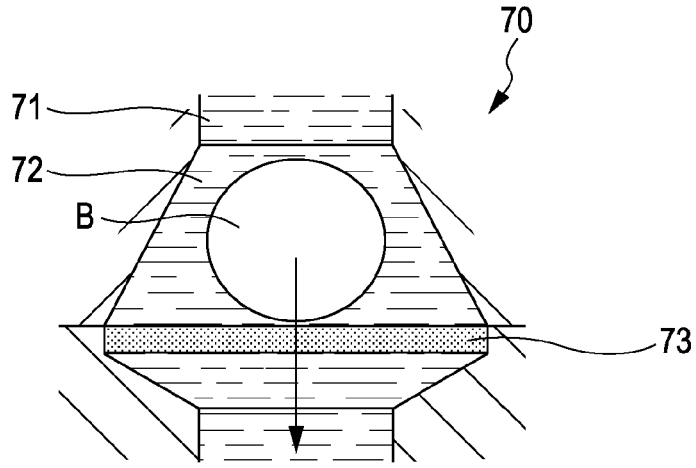
FIGS. 6A to 6C are schematic views illustrating a discharge process of bubbles from a bubble chamber in a liquid introducing needle in the related art.
Figure 6B:
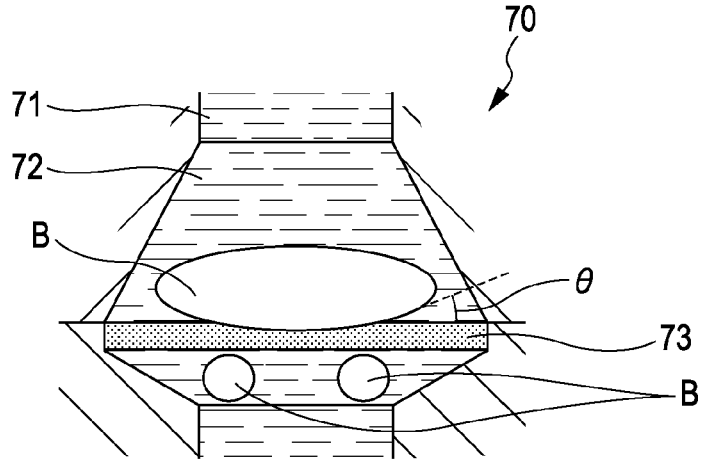
Figure 6C:
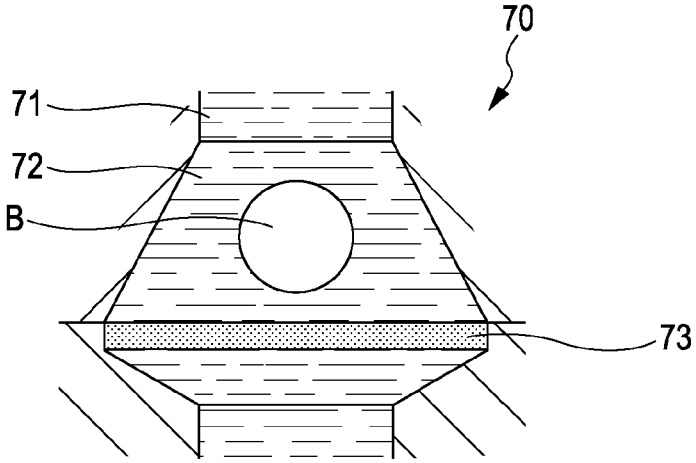

However, the invention is not limited to the above-mentioned embodiments, but various modifications may be possible based on the aspects of the invention. For example, in the liquid introducing needle 14 of the second embodiment shown in FIGS. 5A and 5B, a low void section of a filter 19' is formed in a plate shape (a porosity thereof is almost 0%) through which the bubbles B do not pass. A low-porosity portion of a filter 19' according to the embodiment is formed by a circular-shaped plate portion 24' which is, for example, made from silicon resins having a lyophobic property, or the likes. In an opening at the central portion of the plate portion 24', a filter portion 23' which filtrates the ink passing through the opening and has a lyophobic property is provided. Also, since the other configurations are the same as the above-mentioned embodiments, the description thereof will be omitted.

In the above-mentioned configuration, since the bubble B is spread over the surface of the plate portion 24' in the cleaning operation, the bubble B comes into contact with the filter portion 23' while covering the whole surface of the filter portion 23'. Thereby, the bubbles B are discharged efficiently through the filter portion 23'. Also, since the central portion of the filter 19' is to the filter portion 23' and the low void section is to the plate portion 24', a pressure is further concentrated in the central portion of the bubble B coming into contact with the filter 19' where the bubbles B tend to be congested. Thereby, the bubbles B are discharged more efficiently through the filter 19' by the cleaning operation.

In the above-mentioned embodiments, although the whole surface of the filter 19 facing the bubble chamber 18 side is the lyophobic region 22, the invention is not limited thereto and the lyophobic region 22 may be provided at a region (a peripheral lyophobic region) along a peripheral edge of the filter 19. For example, in the first embodiment, a surface of the low void section 24 facing the bubble chamber 18 side may be a peripheral lyophobic region having a lyophobic property. Also, a lyophilic region showing a lyophilic property (a contact angle with respect to the filter 19 is less than 90°) may be provided at the central portion of the filter 19. For example, in the first embodiment, a surface of the high void section 23 facing the bubble chamber 18 may be a lyophilic region. In the lyophilic region, since the ink goes round and cuts in to the lower side of the bubble, and a contact size between the filter 19 and the bubble becomes small, whereby the bubble is easily separated from the filter 19.

In the above-mentioned configuration, since the bubble is spread along the peripheral edge (over the peripheral lyophobic region) outside the lyophilic region in the cleaning operation, a contact size between the filter 19 and the bubble becomes large. Thereby, the bubbles are discharged efficiently through the filter 19. Also, even if the bubbles still remain at the central portion after the cleaning operation, the bubbles are surely separated from the filter 19. Thereby, it may be possible to prevent a flow of the ink passing through the filter 19 from being disturbed due to the bubbles in the recording operation.

Moreover, in the above-mentioned embodiment, although the liquid introducing needle 14 has been exemplified as the liquid introducing portion, the invention is not limited thereto. For example, the invention may adopt a configuration in which ink is supplied to the recording head side through an ink supply tube. In a printer adopting such a configuration, an ink cartridge is mounted not on the recording head side but on the printer housing side. Also, the ink supply tube is communicated with by the ink cartridge at one end thereof and is communicated with by the bubble chamber of the recording head at the other end thereof. Thereby, the ink is supplied from the ink cartridge to the recording head side through the ink supply tube. In this case, the ink supply tube corresponds to the liquid introducing flow passage according to the aspect of the invention.

Furthermore, in the above-mentioned embodiments, although the so-called vertical vibration type piezoelectric elements 32 have been exemplified as the pressure generating unit, the invention is not limited thereto. For example, the invention may adopt a flexural vibration type piezoelectric element. Moreover, the invention may be applied to a configuration which adopts a pressure generation unit, such as a thermal element which bumps ink by heating to generate a pressure variation, an electrostatic actuator which displaces a partition wall of the pressure chamber by electrostatic force to generate a pressure variation, as a pressure generation unit.

The invention is not limited to the printer, but may also be applied to various ink jet type recording apparatuses such as a plotter, a facsimile apparatus, and a copy machine, or liquid ejecting apparatuses such as a display manufacturing apparatus, an electrode manufacturing apparatus, and a chip manufacturing apparatus, other than the recording apparatuses, as long as the liquid ejecting heads is able to control the ejection of liquids using the pressure generating unit. In the display manufacturing apparatus, solutions of color materials of R (Red), G (Green), and B (Blue) are ejected from a color material ejecting head. Also, in the electrode manufacturing apparatus, a liquid-phase electrode material is ejected from an electrode material ejecting head. Furthermore, in the chip manufacturing apparatus, a solution of a bio-organic substance is ejected from a bio-organic substance ejecting head.

What is claimed is:

1. A liquid ejecting head comprising:

a liquid introducing portion that includes a liquid introducing flow passage that introduces a liquid from a liquid storage member having the liquid stored therein, a bubble chamber that accommodates a bubble entrained into the liquid introducing flow passage, and a filter that is provided at a bottom of the bubble chamber; and a liquid ejecting head main body that introduces the liquid from the liquid introducing portion to a pressure chamber through a liquid flow passage and is able to discharge the liquid in the pressure chamber from nozzles as liquid droplets, wherein a lyophobic region having a lyophobic property is provided on at least an outer peripheral region of a surface of the filter facing an upstream side.

2. The liquid ejecting head according to claim 1, wherein a lyophilic region having a lyophilic property is provided at a central portion of the surface of the filter facing the upstream side.

3. The liquid ejecting head according to claim 1, wherein a high void section having a high-porosity is provided at the central portion of the filter and a low void section of which a porosity is lower than that of the high void section is provided at a peripheral portion of the filter outside the high void section.

4. The liquid ejecting head according to claim 3, wherein the low void section is formed in a plate shape through which the bubbles do not pass.

5. The liquid ejecting head according to claim 1, wherein the lyophobic region is provided on the entire surface of the filter facing the upstream side.

* * * * *